US007578669B2

(12) United States Patent
Liu et al.

(10) Patent No.: US 7,578,669 B2
(45) Date of Patent: Aug. 25, 2009

(54) HYBRID COMBUSTOR FOR FUEL PROCESSING APPLICATIONS

(75) Inventors: Yunquan Liu, Katy, TX (US); Curtis L. Krause, Houston, TX (US); Kevin H. Nguyen, Missouri City, TX (US)

(73) Assignee: Texaco Inc., San Ramon, CA (US)

( * ) Notice: Subject to any disclaimer, the term of this patent is extended or adjusted under 35 U.S.C. 154(b) by 68 days.

(21) Appl. No.: 11/610,983

(22) Filed: Dec. 14, 2006

(65) Prior Publication Data

US 2008/0141675 A1 Jun. 19, 2008

(51) Int. Cl.
*C10L 3/00* (2006.01)
*F23D 3/40* (2006.01)

(52) U.S. Cl. ..... 431/7; 48/127.3; 48/127.5; 48/127.7; 165/154; 165/156; 165/163; 165/169; 122/367.1

(58) Field of Classification Search ..... 431/7; 122/367.1; 165/154, 156, 163, 169; 48/127.7, 48/127.3, 127.5
See application file for complete search history.

(56) References Cited

U.S. PATENT DOCUMENTS 3,522,019 A * 7/1970 Buswell et al. ..... 422/190
4,473,543 A * 9/1984 Setzer et al. ..... 423/652
4,597,734 A * 7/1986 McCausland et al. ..... 431/328
4,702,891 A * 10/1987 Li et al. ..... 422/140
5,004,046 A * 4/1991 Jones ..... 165/156
5,375,999 A * 12/1994 Aizawa et al. ..... 431/328
5,826,429 A * 10/1998 Beebe et al. ..... 60/723
6,302,683 B1 * 10/2001 Vestin et al. ..... 431/7
6,431,856 B1 * 8/2002 Maenishi et al. ..... 431/328
6,497,199 B2 * 12/2002 Yamada et al. ..... 122/367.1
6,797,244 B1 * 9/2004 Lesieur ..... 422/222
6,851,947 B2 * 2/2005 Sugimoto et al. ..... 431/7
2002/0066421 A1 * 6/2002 Yamada et al. ..... 122/367.1
2002/0083646 A1 * 7/2002 Deshpande et al. .... 48/197 FM
2002/0088740 A1 * 7/2002 Krause et al. ..... 208/46
2002/0094310 A1 * 7/2002 Krause et al. ..... 422/191
2002/0098129 A1 * 7/2002 Martin et al. ..... 422/173
2002/0110711 A1 * 8/2002 Boneberg et al. ..... 429/17
2003/0021742 A1 * 1/2003 Krause et al. ..... 422/187
2003/0188475 A1 * 10/2003 Ahmed et al. ..... 44/639
2003/0223926 A1 * 12/2003 Edlund et al. ..... 422/198
2004/0194383 A1 * 10/2004 Wheat et al. ..... 48/197 R
2004/0194384 A1 * 10/2004 Nguyen ..... 48/197 R
2004/0197718 A1 * 10/2004 Deshpande et al. ..... 431/2
2004/0255588 A1 * 12/2004 Lundberg et al. ..... 60/723
2005/0158678 A1 * 7/2005 Wang et al. ..... 431/174

* cited by examiner

*Primary Examiner*—Kenneth B Rinehart
*Assistant Examiner*—Jorge Pereiro
(74) *Attorney, Agent, or Firm*—Melissa Patangia

(57) ABSTRACT

The present invention discloses a hybrid combustor, such as an anode tailgas oxidizer (ATO), for fuel processing applications which combines both flame and catalytic type burners. The hybrid combustor of the present invention combines the advantages of both flame and catalytic type burners. The flame burner component of the hybrid combustor is used during start-up for the preheating of the catalytic burner component. As soon as the catalytic burner bed is preheated or lit off, the flame burner will be shut off. Optionally, the hybrid combustor may also include an integrated heat recovery unit located downstream of the catalytic burner for steam generation and for the preheating of the feed for a reformer, such as an autothermal reformer.

20 Claims, 4 Drawing Sheets

HYBRID COMBUSTOR FOR FUEL PROCESSING APPLICATIONS

FIELD OF THE INVENTION

The present invention relates generally to a hybrid combustor for fuel processing applications that integrates both flame and catalytic burners. Optionally, the hybrid combustor may include an integrated heat recovery unit positioned downstream of the catalytic burner for the preheating of the feed stream or bed of a reforming reactor and for steam generation.

BACKGROUND OF THE INVENTION

Fuel cells provide electricity from chemical oxidation-reduction reactions and possess significant advantages over other forms of power generation in terms of cleanliness and efficiency. Typically, fuel cells employ hydrogen as the fuel and oxygen as the oxidizing agent. The power generation is proportional to the consumption rate of the reactants.

A significant disadvantage which inhibits the wider use of fuel cells is the lack of a widespread hydrogen infrastructure. Hydrogen has a relatively low volumetric energy density and is more difficult to store and transport than the hydrocarbon fuels currently used in most power generation systems. One way to overcome this difficulty is the use of reformers to convert the hydrocarbons to a hydrogen rich gas stream which can be used as a feed for fuel cells.

Hydrocarbon-based fuels, such as natural gas, LPG, gasoline, and diesel, require conversion processes to be used as fuel sources for most fuel cells. Current art uses multi-step processes combining an initial conversion process with several clean-up processes. The initial process is most often steam reforming (SR), autothermal reforming (ATR), catalytic partial oxidation (CPOX), or non-catalytic partial oxidation (POX). The cleanup processes are usually comprised of a combination of desulfurization, high temperature water-gas shift, low temperature water-gas shift, selective CO oxidation, or selective CO methanation. Alternative processes include hydrogen selective membrane reactors and filters.

A combustor, such as an anode tailgas oxidizer (ATO), is a crucial component for fuel processing systems. It combusts reformate, anode tailgas from fuel cells, or pressure swing adsorption unit off-gas to generate heat for reforming systems. All of these gases usually contain a certain amount of hydrogen. For example, reformate is largely a mix of hydrogen and carbon monoxide resulting as the product from the reforming of hydrocarbon feedstocks. Other constituents may include carbon dioxide, steam, nitrogen, and unconverted feedstock.

In addition to burning these gases, a combustor is also required to have the capability of burning fuels like natural gas or propane, especially during the initial start-up of the system.

A combustor could be a single catalytic type combustor. Although catalytic combustors have the advantages of relatively low combustion temperature and clean exhaust (less nitrogen oxides in it) compared to conventional flame type burners, the catalyst beds of catalytic combustors usually need to be preheated for start-up or fuels (e.g. natural gas) need to be preheated to a certain temperature before the combustor can be lit-off. As one option, an electric surface heater can be used to preheat the catalyst bed or natural gas fuel during start-up. In this manner, it usually takes at least 30 minutes to reach the light-off temperature for natural gas. As a result, quite a bit of electric energy (parasitic power) is consumed. Also, due to the fact that the preheating of fuels or combustion air was not incorporated in the design, a catalytic combustor has the difficulty of burning larger amounts of natural gas. Loss of flame frequently occurs due to the relatively slow flame speed of natural gas as compared to its higher superficial velocity at a larger flow rate.

Another problem associated with a common catalytic combustor is that the good mixing of reformate (specifically hydrogen) with air is required, and most of the time happens, outside the combustion zone. This mixing could cause potential safety problems due to the presence of formed hydrogen-air mixtures at their low flammable (or explosive) limit.

To overcome the aforementioned problems associated with a single catalytic combustor, a single flame burner could be used. Flame type burners typically use a spark ignitor to light-off fuels and do not require preheating of fuels (e.g. natural gas) for light-off. Also, unlike catalytic combustors, flame type burners do not require strong pre-mixing of fuels with the combustion air. Rather, fuels can light-off easily with appropriate stoichiometry at normal temperature. However, a flame type burner has to be ignited at a relatively fuel rich condition (i.e., lower oxygen/carbon ratio), thus its combustion temperature is usually higher unless a large amount of secondary air is introduced to dilute the flame. Due to the higher combustion temperature in a flame type burner, it is most likely to form nitrogen oxides in its exhaust in addition to carbon soot. Thus, a single flame burner is neither a long term viable solution nor an ideal solution in terms of the protection of environmental quality. The present invention provides a viable solution to the challenges associated with a catalytic combustor.

SUMMARY OF THE INVENTION

The present invention discloses a hybrid combustor, such as an anode tailgas oxidizer (ATO), for fuel processing applications which combines both flame and catalytic type burners. Optionally, the hybrid combustor may also include an integrated heat recovery unit located downstream of the catalytic burner. In addition to other advantages described below, with the design of the hybrid combustor of the present invention, less energy is consumed for preheating. Overall, the estimated total power saving from preheating is approximately 1.5 kW.

The hybrid combustor of the present invention combines the advantages of both flame and catalytic burners. The flame burner component of the hybrid combustor is used during start-up for the preheating of the catalytic burner component. As soon as the catalytic burner bed is preheated or lit off, the flame burner will be shut off. By combining the characteristics of a flame burner and a catalytic burner, the hybrid combustor improves natural gas burning and provides for quick start-up of the combustor and the whole fuel processing system. Most of the time, the hybrid combustor will only operate on its catalytic burner, therefore, the hybrid combustor also still keeps the advantage of clean combustion.

One of the features of the hybrid combustor is that the flame burner exhaust is used to directly preheat the catalyst bed of the catalytic burner (by passing the catalyst burner bed directly). This manner of preheating is much quicker and more efficient than heating the catalytic burner bed by electric heater. It is estimated that the catalytic burner start-up time can be shortened from approximately 30 minutes to less than one minute.

Another feature of the hybrid combustor of the present invention is that the preheating of fuel or air is integrated inside of the combustor. Therefore, there is no need for separate heating equipment or a separate heating source (e.g. electricity). This integrated fuel preheating design may use a fin type heat exchanger which is very efficient and energy-saving. The integrated fuel preheating design also solves the problems associated with the difficulty of burning large amounts of natural gas, especially burning cold natural gas. Thus, there is no more loss of flame, even at higher natural gas flow.

The design of the hybrid combustor of the present invention also solves the potential safety concerns associated with the mixing of fuel (reformate and/or natural gas) with air far away from the combustion zone. The mixing point of fuel with air in the present invention is located as close to the combustion zone as possible. Thus, as soon as the mixture is formed, it can be consumed via combustion immediately. This minimizes or eliminates the potential safety problems of dealing with an explosive hydrogen-air mixture outside of the combustion zone. In addition, a sparger type fuel distributor may be used which will not only enhance the mixing of the hot air with fuel (to ensure full conversion of fuel on the catalytic bed), but which also minimizes the pressure drop.

In addition to the flame burner and catalyst burner of the present invention, a preheater for secondary air may also be included. Further, the present invention may also include an inline mixer for pre-mixing reformate with natural gas when supplemental natural gas is required for combustion.

Optionally, the hybrid combustor of the present invention may also include an integrated heat recovery unit positioned downstream of the catalytic burner for the preheating of the feed stream or bed of an autothermal reformer (ATR) and for steam generation. With this embodiment of the hybrid combustor of the present invention, an improved fuel processing efficiency and quick start-up of the fuel processing system (e.g. ATR system) would be expected.

The combustion exhaust coming out of the integrated heat recovery unit may follow either of the following two pathways: (1) going to the ATR reactor for direct preheating of the reformer and shift catalyst beds during system start-up; or (2) going to a heat exchanger (the secondary air preheater) for preheating the secondary air for the hybrid combustor itself. One benefit of using the exhaust from the hybrid combustor to preheat the ATR reactor catalyst bed is that the ATR reactor catalyst bed can be preheated much quicker and more uniformly—as a result, the ATR can reach and attain its desired operating point faster. As an additional benefit, due to the quick heating of the ATR reactor, air and steam can be run simultaneously into the ATR reactor earlier which minimizes the soot formation in the ATR bed that is caused by partial oxidation without steam addition.

BRIEF DESCRIPTION OF THE DRAWINGS

The description is presented with reference to the accompanying drawings in which.

DESCRIPTION OF ILLUSTRATIVE EMBODIMENTS

A combustor, such as an anode tailgas oxidizer (ATO), is essential for the operation of fuel processors and fuel cells. The present invention discloses a hybrid combustor, such as an ATO, for fuel processing applications which combines both flame and catalytic burners.

A fuel processor is generally an apparatus for converting hydrocarbon fuel into a hydrogen rich gas. In one embodiment, the compact fuel processor described herein produces a hydrogen rich gas stream from a hydrocarbon fuel for use in fuel cells. However, other possible uses of the methods of the present invention are contemplated, including any use wherein a hydrogen rich stream is desired. Accordingly, while the invention is described herein as being used in conjunction with a fuel cell, the scope of the invention is not limited to such use. Each of the illustrative embodiments describes a fuel processor or a process for using a fuel processor with the hydrocarbon fuel feed being directed through the fuel processor.

The hydrocarbon fuel for the fuel processor may be liquid or gas at ambient conditions as long as it can be vaporized. As used herein the term "hydrocarbon" includes organic compounds having C—H bonds which are capable of producing hydrogen from a partial oxidation or steam reforming reaction. The presence of atoms other than carbon and hydrogen in the molecular structure of the compound is not excluded. Thus, suitable fuels for the fuel processor include, but are not limited to hydrocarbon fuels such as natural gas, methane, ethane, propane, butane, naphtha, gasoline, and diesel fuel, and alcohols such as methanol, ethanol, propanol, and the like.

The fuel processor feeds include hydrocarbon fuel, oxygen, and water. The oxygen can be in the form of air, enriched air, or substantially pure oxygen. The water can be introduced as a liquid or vapor. The composition percentages of the feed components are determined by the desired operating conditions, as discussed below.

The fuel processor effluent stream includes hydrogen and carbon dioxide and can also include some water, unconverted hydrocarbons, carbon monoxide, impurities (e.g. hydrogen sulfide and ammonia) and inert components (e.g., nitrogen and argon, especially if air was a component of the feed stream).

Figure 1:
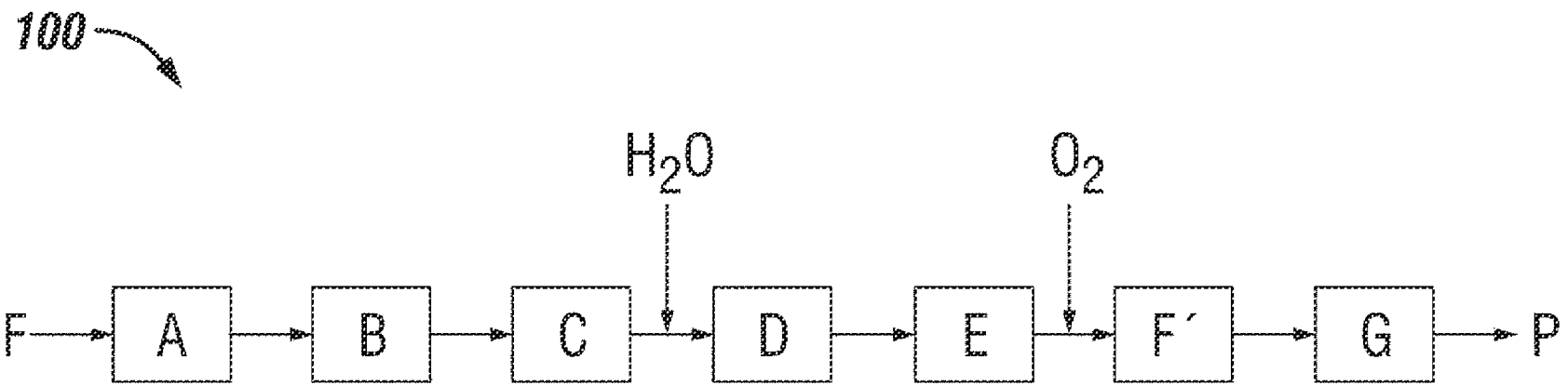
FIG. 1 depicts a simple process flow diagram for a fuel processor.

With reference to FIG. 1, FIG. 1 depicts a simple process flow diagram for a fuel processor illustrating the process steps included in converting a hydrocarbon fuel into a hydrogen rich gas. One of skill in the art should appreciate that a certain amount of progressive order is needed in the flow of the reactants through the reactors disclosed herein.

Process step A is an autothermal reforming process in which two reactions, partial oxidation (formula I, below) and optionally also steam reforming (formula II, below), are combined to convert the feed stream F into a synthesis gas containing hydrogen and carbon monoxide. Formulas I and II are exemplary reaction formulas wherein methane is considered as the hydrocarbon:

$$CH_4+\tfrac{1}{2}O_2 \rightarrow 2H_2+CO \quad \text{(I)}$$

$$CH_4+H_2O \rightarrow 3H_2+CO \quad \text{(II)}$$

The partial oxidation reaction occurs very quickly to the complete conversion of oxygen added and produces heat: The steam reforming reaction occurs slower and consumes heat. A higher concentration of oxygen in the feed stream favors partial oxidation whereas a higher concentration of water vapor favors steam reforming. Therefore, the ratios of oxygen to hydrocarbon and water to hydrocarbon become characterizing parameters. These ratios affect the operating temperature and hydrogen yield.

The operating temperature of the autothermal reforming step can range from about 550° C. to about 900° C., depending on the feed conditions and the catalyst. The invention uses a catalyst bed of a partial oxidation catalyst with or without a steam reforming catalyst. The catalyst may be in any form including pellets, spheres, extrudate, monoliths, and the like. Partial oxidation catalysts should be well known to those with skill in the art and are often comprised of noble metals such as platinum, palladium, rhodium, and/or ruthenium on an alumina washcoat on a monolith, extrudate, pellet or other support. Non-noble metals such as nickel or cobalt have been used. Other washcoats such as titania, zirconia, silica, and magnesia have been cited in the literature. Many additional materials such as lanthanum, cerium, and potassium have been cited in the literature as "promoters" that improve the performance of the partial oxidation catalyst.

Steam reforming catalysts should be known to those with skill in the art and can include nickel with amounts of cobalt or a noble metal such as platinum, palladium, rhodium, ruthenium, and/or iridium. The catalyst can be supported, for example, on magnesia, alumina, silica, zirconia, or magnesium aluminate, singly or in combination. Alternatively, the steam reforming catalyst can include nickel, preferably supported on magnesia, alumina, silica, zirconia, or magnesium aluminate, singly or in combination, promoted by an alkali metal such as potassium.

Process step B is a cooling step for cooling the synthesis gas stream from process step A to a temperature of from about 200° C. to about 600° C., preferably from about 300° C. to about 500° C., and more preferably from about 375° C. to about 425° C., to optimize the temperature of the synthesis gas effluent for the next step. This cooling may be achieved with heat sinks, heat pipes or heat exchangers depending upon the design specifications and the need to recover/recycle the heat content of the gas stream. One illustrative embodiment for step B is the use of a heat exchanger utilizing feed stream F as the coolant circulated through the heat exchanger. The heat exchanger can be of any suitable construction known to those with skill in the art including shell and tube, plate, spiral, etc. Alternatively, or in addition thereto, cooling step B may be accomplished by injecting additional feed components such as fuel, air or water. Water is preferred because of its ability to absorb a large amount of heat as it is vaporized to steam. The amounts of added components depend upon the degree of cooling desired and are readily determined by those with skill in the art.

Process step C is a purifying step. One of the main impurities of the hydrocarbon stream is sulfur, which is converted by the autothermal reforming step A to hydrogen sulfide. The processing core used in process step C preferably includes zinc oxide and/or other material capable of absorbing and converting hydrogen sulfide, and may include a support (e.g., monolith, extrudate, pellet etc.). Desulfurization is accomplished by converting the hydrogen sulfide to water in accordance with the following reaction formula III:

$$H_2S+ZnO \rightarrow H_2O+ZnS \quad \text{(III)}$$

Other impurities such as chlorides can also be removed. The reaction is preferably carried out at a temperature of from about 300° C. to about 500° C., and more preferably from about 375° C. to about 425° C. Zinc oxide is an effective hydrogen sulfide absorbent over a wide range of temperatures from about 25° C. to about 700° C. and affords great flexibility for optimizing the sequence of processing steps by appropriate selection of operating temperature.

The effluent stream may then be sent to a mixing step D in which water is optionally added to the gas stream. The addition of water lowers the temperature of the reactant stream as it vaporizes and supplies more water for the water gas shift reaction of process step E (discussed below). The water vapor and other effluent stream components are mixed by being passed through a processing core of inert materials such as ceramic beads or other similar materials that effectively mix and/or assist in the vaporization of the water. Alternatively, any additional water can be introduced with feed, and the mixing step can be repositioned to provide better mixing of the oxidant gas in the CO oxidation step G disclosed below.

Process step E is a water gas shift reaction that converts carbon monoxide to carbon dioxide in accordance with formula IV:

$$H_2O+CO \rightarrow H_2+CO_2 \quad \text{(IV)}$$

This is an important step because carbon monoxide, in addition to being highly toxic to humans, is a poison to fuel cells. The concentration of carbon monoxide should preferably be lowered to a level that can be tolerated by fuel cells, typically below 50 ppm. Generally, the water gas shift reaction can take place at temperatures of from 150° C. to 600° C. depending on the catalyst used. Under such conditions, most of the carbon monoxide in the gas stream is converted in this step.

Low temperature shift catalysts operate at a range of from about 150° C. to about 300° C. and include for example, copper oxide, or copper supported on other transition metal oxides such as zirconia, zinc supported on transition metal oxides or refractory supports such as silica, alumina, zirconia, etc., or a noble metal such as platinum, rhenium, palladium, rhodium or gold on a suitable support such as silica, alumina, zirconia, and the like.

High temperature shift catalysts are preferably operated at temperatures ranging from about 300° C. to about 600° C. and can include transition metal oxides such as ferric oxide or chromic oxide, and optionally including a promoter such as copper or iron suicide. Also included, as high temperature shift catalysts are supported noble metals such as supported platinum, palladium and/or other platinum group members.

The processing core utilized to carry out this step can include a packed bed of high temperature or low temperature shift catalyst such as described above, or a combination of both high temperature and low temperature shift catalysts. The process should be operated at any temperature suitable for the water gas shift reaction, preferably at a temperature of from 150° C. to about 400° C. depending on the type of catalyst used. Optionally, a cooling element such as a cooling coil may be disposed in the processing core of the shift reactor to lower the reaction temperature within the packed bed of catalyst. Lower temperatures favor the conversion of carbon monoxide to carbon dioxide. Also, a purification processing step C can be performed between high and low shift conversions by providing separate steps for high temperature and low temperature shift with a desulfurization module between the high and low temperature shift steps.

Process step F' is a cooling step performed in one embodiment by a heat exchanger. The heat exchanger can be of any suitable construction including shell and tube, plate, spiral, etc. Alternatively a heat pipe or other form of heat sink may be utilized. The goal of the heat exchanger is to reduce the temperature of the gas stream to produce an effluent having a temperature preferably in the range of from about 90° C. to about 150° C.

Oxygen is added to the process in step F'. The oxygen is consumed by the reactions of process step G described below. The oxygen can be in the form of air, enriched air, or substantially pure oxygen. The heat exchanger may by design provide mixing of the air with the hydrogen rich gas. Alternatively, the embodiment of process step D may be used to perform the mixing.

Process step G is an oxidation step wherein almost all of the remaining carbon monoxide in the effluent stream is converted to carbon dioxide. The processing is carried out in the presence of a catalyst for the oxidation of carbon monoxide and may be in any suitable form, such as pellets, spheres, monolith, etc. Oxidation catalysts for carbon monoxide are known and typically include noble metals (e.g., platinum, palladium) and/or transition metals (e.g., iron, chromium, manganese), and/or compounds of noble or transition metals, particularly oxides. A preferred oxidation catalyst is platinum on an alumina washcoat. The washcoat may be applied to a monolith, extrudate, pellet or other support. Additional materials such as cerium or lanthanum may be added to improve performance. Many other formulations have been cited in the literature with some practitioners claiming superior performance from rhodium or alumina catalysts. Ruthenium, palladium, gold, and other materials have been cited in the literature as being active for this use.

Two reactions occur in process step G: the desired oxidation of carbon monoxide (formula V) and the undesired oxidation of hydrogen (formula VI) as follows:

$$CO+\tfrac{1}{2}O_2 \rightarrow CO_2 \quad (V)$$

$$H_2+\tfrac{1}{2}O_2 \rightarrow H_2O \quad (VI)$$

The preferential oxidation of carbon monoxide is favored by low temperatures. Since both reactions produce heat it may be advantageous to optionally include a cooling element such as a cooling coil disposed within the process. The operating temperature of the process is preferably kept in the range of from about 90° C. to about 150° C. Process step G preferably reduces the carbon monoxide level to less than 50 ppm, which is a suitable level for use in fuel cells, but one of skill in the art should appreciate that the present invention can be adapted to produce a hydrogen rich product with higher and lower levels of carbon monoxide.

The effluent exiting the fuel processor is a hydrogen rich gas containing carbon dioxide and other constituents which may be present such as water, inert components (e.g., nitrogen, argon), residual hydrocarbon, etc. Product gas may be used as the feed for a fuel cell or for other applications where a hydrogen rich feed stream is desired. Optionally, product gas may be sent on to further processing, for example, to remove the carbon dioxide, water or other components.

Fuel processor 100 contains a series of process units for carrying out the general process as described in FIG. 1. It is intended that the process units may be used in numerous configurations as is readily apparent to one skilled in the art. Furthermore, the fuel processor described herein is adaptable for use in conjunction with a fuel cell such that the hydrogen rich product gas of the fuel processor described herein is supplied directly to a fuel cell as a feed stream.

Figure 2:
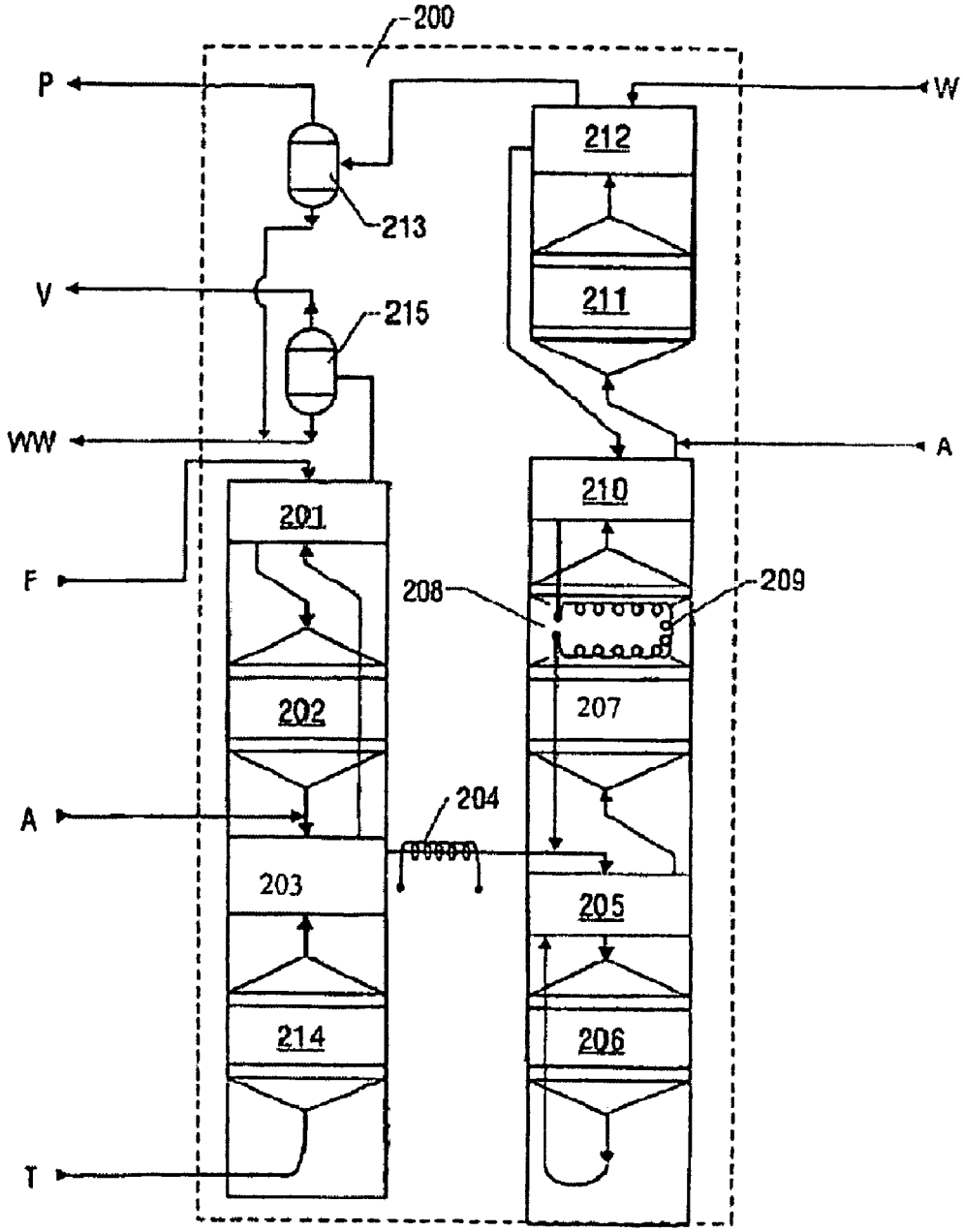
FIG. 2 illustrates an embodiment of a compact fuel processor.

With reference to FIG. 2, FIG. 2 illustrates an embodiment of a compact fuel processor. Fuel processor 200 as shown in FIG. 2 is similar to the process diagrammatically illustrated in FIG. 1 and described supra. Hydrocarbon fuel feed stream F is introduced to the fuel processor and hydrogen rich product gas P is drawn off. Fuel processor 200 includes several process units that each perform a separate operational function and is generally configured as shown in FIG. 2. In this illustrative embodiment, the hydrocarbon fuel F enters the first compartment into spiral exchanger 201, which preheats the feed F against fuel cell tail gas T (enters fuel processor 200 at ATO 214). Because of the multiple exothermic reactions that take place within the fuel processor, one of skill in the art should appreciate that several other heat integration opportunities are also plausible in this service. This preheated feed then enters desulfurization reactor 202 through a concentric diffuser for near-perfect flow distribution and low pressure drop at the reactor inlet. Reactor 202 contains a desulfurizing catalyst and operates as described in process step C of FIG. 1. (Note that this step does not accord with the order of process steps as presented in FIG. 1. This is a prime example of the liberty that one of skill in the art may exercise in optimizing the process configuration in order to process various hydrocarbon fuel feeds and/or produce a more pure product.) Desulfurized fuel from reactor 202 is then collected through a concentric diffuser and mixed with air A, with the mixture being routed to exchanger 203. In this illustrative embodiment, exchanger 203 is a spiral exchanger that heats this mixed fuel/air stream against fuel cell tail gas T (enters fuel processor 200 at ATO 214).

The preheated fuel/air mixture then enters the second compartment with the preheat temperature maintained or increased by electric coil heater 204 located between the two compartments. The preheated fuel-air mixture enters spiral exchanger 205, which preheats the stream to autothermal reforming reaction temperature against the autothermal reformer (ATR) 206 effluent stream. Preheated water (enters fuel processor 200 at exchanger 212) is mixed with the preheated fuel-air stream prior to entering exchanger 205. The preheated fuel-air-water mixture leaves exchanger 205 through a concentric diffuser and is then fed to the ATR 206, which corresponds to process step A of FIG. 1. The diffuser allows even flow distribution at the ATR 206 inlet. The hot hydrogen product from the ATR 206 is collected through a concentric diffuser and routed back to exchanger 205 for heat recovery. In this embodiment, exchanger 205 is mounted directly above the ATR 206 in order to minimize flow path, thereby reducing energy losses and improving overall energy efficiency. Flow conditioning vanes can be inserted at elbows in order to achieve low pressure drop and uniform flow through the ATR 206.

The cooled hydrogen product from exchanger 205 is then routed through a concentric diffuser to desulfurization reactor 207, which corresponds to process step C of FIG. 1. The desulfurized product is then fed to catalytic shift reactor 208, which corresponds with process step E in FIG. 1. Cooling coil 209 is provided to control the exothermic shift reaction temperature, which improves carbon monoxide conversion leading to higher efficiency. In this embodiment, cooling coil 209 also preheats ATR 206 feed, further improving heat recovery and fuel cell efficiency. The shift reaction product is then collected through a concentric diffuser and is cooled in spiral exchanger 210, which also preheats water feed W.

Air A is then introduced to the cooled shift reaction product, which is then routed to a concentric diffuser feeding preferred CO oxidation reactor 211. Reactor 211 oxidizes trace carbon monoxide to carbon dioxide, which corresponds to process step G in FIG. 1. Flow conditioning vanes may be inserted at elbows to achieve short flow paths and uniform low pressure drop throughout reactor 211. The effluent purified hydrogen stream is then collected in a concentric diffuser and is sent to exchanger 212 which recovers heat energy into the water feed W. The cooled hydrogen stream is then flashed in separator 213 to remove excess water W. The hydrogen gas stream P from separator 213 is then suitable for hydrogen users, such as a fuel cell.

In the embodiment described in FIG. 2, the combined anode and cathode vent gas streams from a fuel cell are introduced to fuel processor 200 for heat recovery from the unconverted hydrogen in the fuel cell. Integration of the fuel cell with the fuel processor considerably improves the overall efficiency of electricity generation from the fuel cell. The fuel cell tail gas T flows through a concentric diffuser to ATO 214. Hydrogen, and possibly a slip stream of methane and other light hydrocarbons are catalytically oxidized according to:

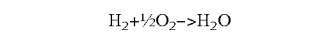

$$CH_4+2O_2 \rightarrow CO_2+2H_2O \quad \text{(VII)}$$

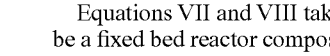

$$H_2+\tfrac{1}{2}O_2 \rightarrow H_2O \quad \text{(VIII)}$$

Equations VII and VIII take place in ATO 214, which can be a fixed bed reactor composed of catalyst pellets on beads, or preferably a monolithic structured catalyst. The hot reactor effluent is collected through a concentric diffuser and is routed to exchanger 203 for heat recovery with the combined fuel/air mixture from reactor 202. Heat from the fuel cell tail gas stream T is then further recovered in exchanger 201 before being flashed in separator 215. The separated water is connected to the processor effluent water stream W and the vent gas is then vented to the atmosphere.

Figure 3:
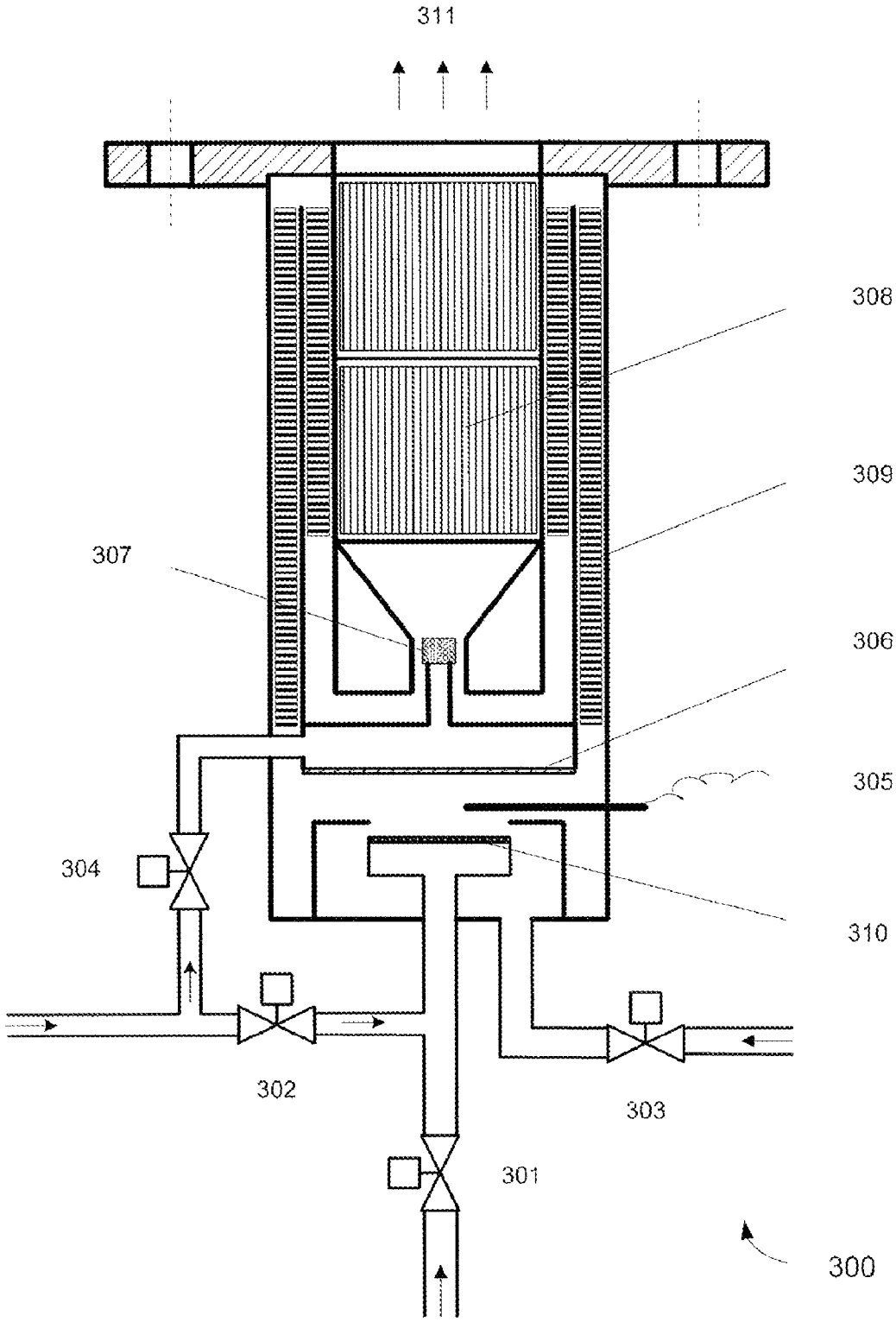
FIG. 3 illustrates an embodiment of a hybrid combustor.

With reference to FIG. 3, FIG. 3 illustrates an embodiment of the hybrid combustor (such as an anode tailgas oxidizer (ATO)) 300 of the present invention for fuel processing applications. The hybrid combustor 300 includes a first valve 301 for allowing the entrance of primary air into the hybrid combustor 300; a second valve 302 for allowing the entrance of fuel (typically natural gas; propane, in addition to other fuels, may also be used) into the hybrid combustor 300; a third valve 303 for allowing the entrance of secondary air into the hybrid combustor 300; and a fourth valve 304 for allowing the entrance of fuel (typically natural gas and/or reformate) into the hybrid combustor 300. The mixing point of the fuel, the primary air, and the secondary air is located just right before combustion zone of the hybrid combustor 300.

As shown in FIG. 3, the hybrid combustor 300 also includes a flame burner 310 with a spark ignitor 305 used for startup of the hybrid combustor 300; a high temperature deflectory plate 306; a reformate distributor 307; a catalytic burner 308; and a heat exchanger 309. The reformate distributor 307 may be a sparger type reformate distributor. The catalyst bed of the catalytic burner 308 may be a monolith catalyst bed or a pellet type catalyst bed. The heat exchanger 309 may be a rolled fin type heat exchanger.

The exhaust from the flame burner 310 preheats the catalyst bed of the catalytic burner 308 by passing the catalyst bed directly. The flame burner 310 shuts off automatically after the catalyst bed of the catalytic burner 308 is preheated. The exhaust 311 from the catalytic burner 308 may be used to preheat a reforming bed such as an autothermal reforming bed.

The hybrid combustor 300 of the present invention is operated by first opening the first valve 301 to allow the entrance of primary air into the hybrid combustor 300 to purge the hybrid combustor 300 with the primary air. The primary air may be set at a rate such as 100 slpm during the start-up. The primary air may be allowed to flow for a few seconds. The purged gas is vented to an exhaust line while the flow of primary air is maintained.

Next, the flow of primary air is reduced (to a value such as 36 slpm) and then the second valve 302 is opened. Opening the second valve 302 also allows the flow of fuel (such as natural gas set at a rate of, for example, 3 slpm) through the second valve 302. Then, the spark ignitor 305 of the flame burner 310 is activated to immediately to light off the flame burner 310. A thermocouple is monitored for temperature change of the flame burner 310.

Next, the third valve 303 is opened to allow the entrance of secondary air to cool the flame down, as necessary, after the activation of the spark ignitor 305 of the flame burner 310. The flow of secondary air is controlled to prevent the catalyst bed of the catalytic burner 308 from sintering. The diluted flame exhaust temperature should not exceed 800° C. to prevent sintering. For example, for the case of natural gas at 3 slpm and primary air at 36 slpm, the secondary air flow should be controlled to greater than 27 slmp. In this example, with secondary air added, the overall oxygen to carbon ratio is 4.4.

The flame burner 310 is run for a few seconds (for example, 30 seconds) with secondary air to heat the heat exchanger 309 and the catalyst bed of the catalytic burner 308. Once the catalyst bed of the catalytic burner 308 reaches the desired temperature (for example, 400° C.), the second valve 302 is then closed to stop the flow of fuel through the second valve 302, automatically shutting off the flame burner 310 due to the stoppage of fuel to the flame burner 310. Air may still flow through the flame burner 310 to pick up the heat trapped in the flame burner 310 and the heat exchanger 309.

Next, the fourth valve 304 is opened to let the fuel flow into the catalytic burner 308 via the reformate distributor 307. The preheated air mixes with the fuel at the neck of the conical shaped can where the natural gas is distributed to the air continuously via the reformate distributor 307. Due to the very high velocity of the air at the annular throat, good mixing between the fuel and the air is achieved. As the catalyst bed of the catalytic burner 308 is already hot enough, the fuel-air mixture will be lit off when it hits the catalytic bed of the catalytic burner 308. Here, the air and the fuel are mixed at a mixing point right before the combustion zone of the said hybrid combustor 300.

The actual flow rate of said natural gas is determined based on the flow of primary air and the required oxygen to carbon ratio. For example, an oxygen to carbon ratio of 2.5 may be used. The natural gas may be preheated by direct mixing with hot air from the heat exchanger 309.

When anode tailgas gas or pressure swing adsorption unit off-gas is available, the natural gas will be switched to the reformate. As burning reformate (due to the presence of hydrogen) is much easier than burning natural gas, the switch should not cause a problem. In case supplemental natural gas is needed, the natural gas can be mixed together with the reformate first and fed into the catalytic burner 308.

Figure 4:
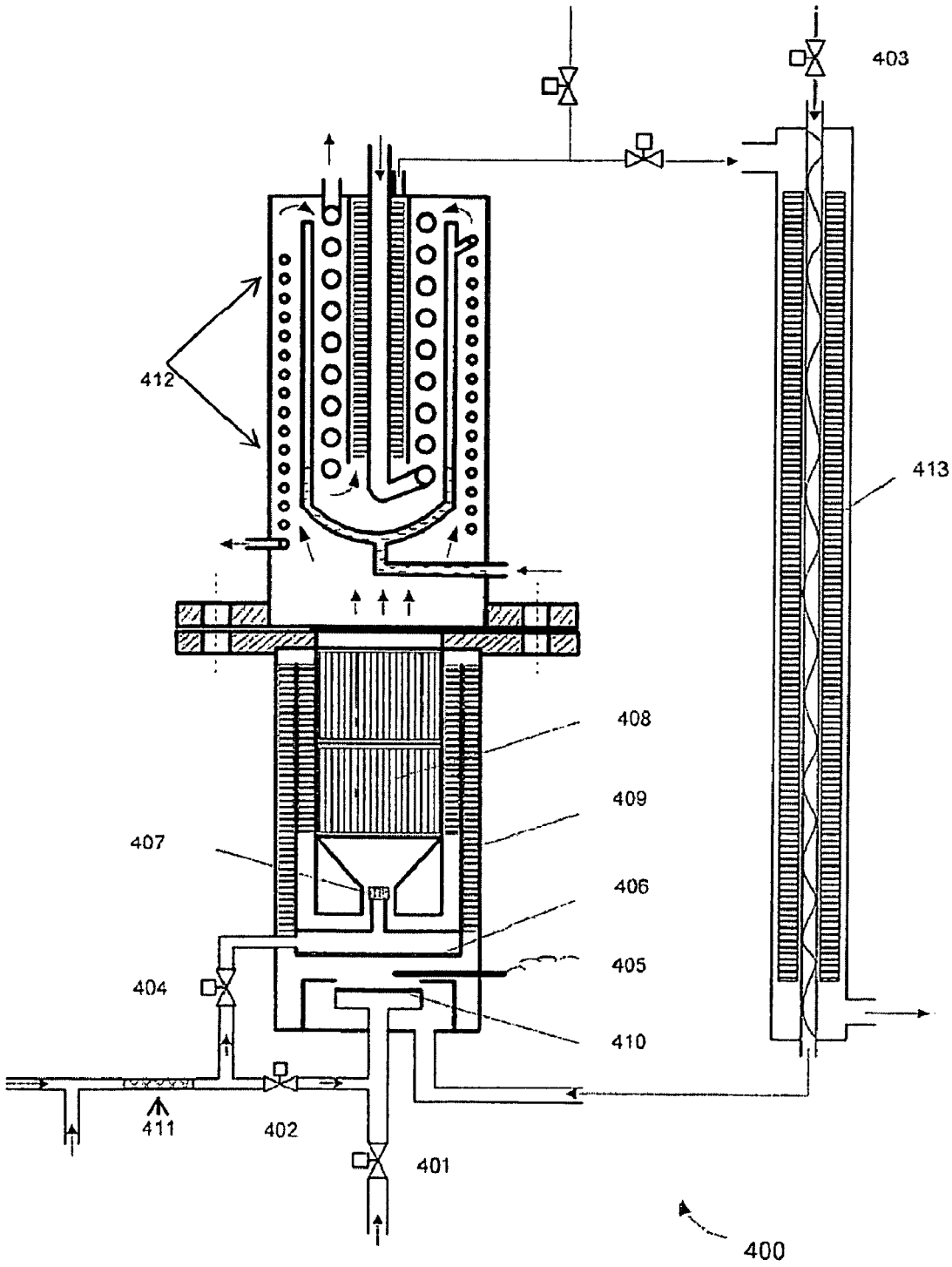
FIG. 4 illustrates a second embodiment of a hybrid combustor.

With reference to FIG. 4, FIG. 4 illustrates a second embodiment of the hybrid combustor 400 of the present invention for fuel processing applications. Like the embodiment illustrated in FIG. 3, the hybrid combustor 400 includes a first valve 401 for allowing the entrance of primary air into the hybrid combustor 400; a second valve 402 for allowing the entrance of fuel (typically natural gas; propane, in addition to other fuels, may also be used) into the hybrid combustor 400; a third valve 403 for allowing the entrance of secondary air into the hybrid combustor 400; and a fourth valve 404 for allowing the entrance of fuel (typically natural gas and/or reformate) into the hybrid combustor 400. The mixing point of the fuel, the primary air, and the secondary air is located right before combustion zone of the hybrid combustor 400.

As shown in FIG. 4 and as similar to FIG. 3, the hybrid combustor 400 also includes a flame burner 410 with a spark ignitor 405 used for startup of the hybrid combustor 400; a high temperature deflectory plate 406; a reformate distributor 407; a catalytic burner 408; and a heat exchanger 409. The reformate distributor 407 may be a sparger type reformate distributor. The catalyst bed of the catalytic burner 408 may be a monolith catalyst bed. The heat exchanger 409 may be a rolled fin type heat exchanger.

The embodiment of the hybrid combustor 400 illustrated in FIG. 4 also includes a secondary air preheater 413, an inline mixer 411, and an integrated heat recovery unit 412. The integrated heat recovery unit 412 includes a cylindrical annulus wherein flue gas from the catalytic burner 408 passes through the said cylindrical annulus three times (either up or down) instead of just one pass which greatly increases the residence time of the hot flue gas contacting with the cold streams, thus enhancing heat transfer.

The integrated heat recovery unit 412 also includes a boiler. The boiler is a compromise of both flow boiling and pool boiling. For example, the water inside the bell shape annulus can actually flow upward just like a flow boiling—but it does not form slug easily as there is a big open space at the top for knocking liquid droplets down, which makes the two-phase flow non-continuous. On the other hand, the boiler also looks like a pool boiling as there is always some water remaining in the annular reservoir due to continued feeding of water and the minimum water level is usually kept there under steady state conditions. In addition, the boiler has better turn-down ratio for steam production because the boiling heat transfer area will change with the water level which correspondingly changes with the water flow rate.

The integrated heat recovery unit 412 also includes a bell shaped evaporator; big coils for gas further heating; small coils for steam superheating; and a rolled fin type heat exchanger. The fin type heat exchanger is implemented in the design to enhance gas-gas heat transfer at locations where hot source gas has already been cooled down.

The design of the integrated heat recovery unit 412 increases the heat transfer efficiency by increasing the contacting time between the hot flue gas and cold streams. The design also minimizes the unfavorable slug formation often encountered in a flow boiling type heat exchanger due to smaller coil diameter—thus with this design, more stable steam production can be achieved. In addition, the boiler has better turn-down ratio for steam production as the boiling heat transfer surface area can change with the water flow rate. Finally, with the design of the integrated heat recovery unit 412, steam or gas can be heated to a higher temperature due to the counter-current flow path design between hot flue gas and cold streams.

Combustion exhaust from the integrated heat recovery unit 412 may be piped to the secondary air preheater 413. Combustion exhaust from the integrated heat recovery unit 412 may also be piped to a reforming reactor, such as an autothermal reforming (ATR) or steam methane reforming (SMR) reactor, for direct preheating of the reformer bed and the shift bed during the start-up of the ATR reactor. In addition, the natural gas for the hybrid combustor 400 may be preheated by direct mixing with the hot secondary air from the integrated rolled fin heat exchanger.

The hybrid combustor 400 of this embodiment is operated in the same manner as the hybrid combustor 300 of the embodiment described above with respect to FIG. 3.

While the methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

What is claimed is:

1. A hybrid combustor comprising:

a first valve for allowing entrance of primary air into said hybrid combustor;

a second valve for allowing entrance of fuel into said hybrid combustor;

a third valve for allowing entrance of secondary air into said hybrid combustor;

a flame burner with a spark ignitor for startup of said hybrid combustor;

a high temperature deflectory plate;

a fourth valve for allowing entrance of said fuel into said hybrid combustor wherein mixing point of said fuel, said primary air, and said secondary air is located right before combustion zone of said hybrid combustor;

a reformate distributor;

a catalytic burner wherein said catalytic burner comprises a catalyst bed;

a heat exchanger;

an integrated heat recovery unit located downstream of said catalytic burner wherein said integrated heat recovery unit comprises a cylindrical annulus wherein flue gas from said catalytic burner passes through said cylindrical annulus three times;

a boiler wherein said boiler compromises both flow boiling and pool boiling;

a bell shaped evaporator; big coils for gas further heating; small coils for steam superheating; and a rolled fin type heat exchanger.

2. The hybrid combustor of claim 1, further comprising a secondary air preheater.

3. The hybrid combustor of claim 1, further comprising an inline mixer located upstream of said fourth valve.

4. The hybrid combustor of claim 1, wherein combustion exhaust from said integrated heat recovery unit is piped to a reforming reactor for direct preheating of reformer bed and shift bed during start-up of said reforming reactor.

5. The hybrid combustor of claim 4, wherein said reforming reactor is an autothermal reforming reactor.

6. The hybrid combustor of claim 1, further comprising a secondary air preheater wherein combustion exhaust from said integrated heat recovery unit is piped to said secondary air preheater.

7. The hybrid combustor of claim 1, wherein exhaust from said flame burner preheats said catalyst bed by passing said catalyst bed directly.

8. The hybrid combustor of claim 7, wherein said flame burner automatically shuts off after said catalyst bed is preheated.

9. The hybrid combustor bf claim 1, wherein said reformate distributor is a sparger type reformate distributor.

10. The hybrid combustor of claim 1, wherein said catalyst bed is a monolith catalyst bed.

11. The. hybrid combustor of claim 1, wherein said heat exchanger is a rolled fin type heat exchanger.

12. The hybrid combustor of claim 1, wherein said hybrid combustor is a hybrid anode tailgas oxidizer.

13. The hybrid combustor of claim 1, wherein exhaust from said hybrid combustor preheats a reforming bed.

14. The hybrid combustor of claim 13, wherein said reforming bed is an autothermal reforming bed.

15. A method for operating a hybrid combustor comprising:

opening a first valve to allow the entrance of primary air into said hybrid combustor to purge said hybrid combustor with said primary air;

venting purged gas to an exhaust line while maintaining flow of said primary air;

reducing flow of said primary air; allowing flow of fuel through said second valve;

activating a spark ignitor of aflame burner immediately to light off said flame burner;

monitoring a thermocouple for temperature change of said flame burner;

opening a third valve to allow flow of secondary air after activation of said spark ignitor to cool flame down;

controlling flow of said secondary air to prevent catalyst bed from sintering;

running said flame burner with said secondary air to heat a heat exchanger and said catalyst bed;

closing said second valve to stop flow of said fuel through said second valve automatically shutting off said flame burner;

opening a fourth valve to let said fuel flow into a catalytic burner via a distributor wherein an integrated heat recovery unit is located downstream of said catalytic burner wherein said integrated heat recovery unit comprises a cylindrical annulus wherein flue gas from said catalytic burner passes through said cylindrical annulus three times; a boiler wherein said boiler compromises both flow boiling and pool boiling; a bell shaped evaporator; big coils for gas further heating; small coils for steam superheating; and a rolled fin type heat exchanger; and mixing said primary air, said secondary air, and said fuel at mixing point wherein said mixing point is right before combustion zone of said hybrid combustor.

16. The method for operating a hybrid combustor of claim 15, wherein flow of said natural gas, is determined based flow of said primary air and required oxygen to carbon ratio.

17. The method for operating a hybrid combustor of claim 15, further comprising preheating said natural gas by direct mixing with hot air from said heat exchanger.

18. The method for operating a hybrid combustor of claim 15, wherein exhaust from said hybrid combustor preheats a reforming bed.

19. The method for operating a hybrid combustor of claim 18, wherein said reforming bed is an autothermal reforming bed.

20. The method for operating a hybrid combustor of claim 15, wherein said hybrid combustor is a hybrid anode tailgas oxidizer.

* * * * *